US006761017B1

(12) United States Patent
Rossi et al.

(10) Patent No.: US 6,761,017 B1
(45) Date of Patent: Jul. 13, 2004

(54) APPARATUS FOR GRIPPING AND CUTTING FILM USED FOR WRAPPING A PALLETIZED LOAD

(75) Inventors: Bruno Rossi, Rimini (IT); Rodolfo Bettini, Bologna (IT)

(73) Assignee: Robopac S.A., Falciano (SM)

( * ) Notice: Subject to any disclaimer, the term of this patent is extended or adjusted under 35 U.S.C. 154(b) by 0 days.

(21) Appl. No.: 10/031,192

(22) PCT Filed: Jul. 10, 2000

(86) PCT No.: PCT/IB00/00930

§ 371 (c)(1),
(2), (4) Date: Jan. 14, 2002

(87) PCT Pub. No.: WO01/05661

PCT Pub. Date: Jan. 25, 2001

(30) Foreign Application Priority Data

Jul. 16, 1999 (IT) ..... BO99A0402

(51) Int. Cl.[7] ..... B65B 49/00
(52) U.S. Cl. ..... 53/587; 53/211
(58) Field of Search ..... 53/467, 587, 588, 53/211, 389.3

(56) References Cited

U.S. PATENT DOCUMENTS 4,216,640 A 8/1980 Kaufman
4,255,918 A 3/1981 Lancaster et al.
4,845,920 A * 7/1989 Lancaster ..... 53/399
4,972,656 A 11/1990 Haugstad
5,138,818 A 8/1992 Humphrey
5,452,566 A 9/1995 Benhamou et al.
5,941,049 A * 8/1999 Lancaster et al. ..... 53/399
6,164,047 A 12/2000 Rossi
6,269,610 B1 8/2001 Lancaster, III et al.
6,526,729 B1 * 3/2003 Herava ..... 53/465

FOREIGN PATENT DOCUMENTS

EP 0 630 813 A1 12/1994
WO WO 99/06279 2/1999

* cited by examiner

*Primary Examiner*—Rinaldi I. Rada
*Assistant Examiner*—John Paradiso
(74) *Attorney, Agent, or Firm*—Fay, Sharpe, Fagan, Minnich & McKee, LLP

(57) ABSTRACT

An apparatus for holding and cutting film (1) comprises a unit (6) for gripping and tearing the film (1), located outside the profile of the platform (2) and designed to enable a portion of film of width (L1) between a stack (3) of products on the platform (2) and a film feed reel (4) to be intercepted after the stack (3) has been wrapped and to subsequently tear the portion of film (1) thus intercepted, acting in conjunction with a partial rotation of the platform (2).

10 Claims, 4 Drawing Sheets

APPARATUS FOR GRIPPING AND CUTTING FILM USED FOR WRAPPING A PALLETIZED LOAD

TECHNICAL FIELD

The present invention relates to an apparatus for holding and dividing film used to wrap groups of products. In particular this unit can be applied to machines for the semi-automatic wrapping of stacked products arranged on pallets for transportation of the stacks.

BACKGROUND ART

In the sector for the design and construction of machines for wrapping stacked products, manufacturers have, over time, used two different construction philosophies, which have led to the definition of two types of machines, respectively automatic and semi-automatic.

These two types originate from a similar basic structure which comprises a support platform for the pallet upon which the group of products to be wrapped rests, and a frame, at the side of the platform, upon which a reel of film for wrapping the group of products is positioned.

In the case of automatic machines, there are solutions which envisage a rotating platform and in which the reel only moves vertically up and down in order to unwind the film along the group of products, or solutions with a fixed platform and a reel which moves vertically and is supported by an arm which rotates around the group of products.

In semi-automatic machines, the first type of system described above for automatic machines is normally used, that is to say, with the rotating platform and a reel which moves in both directions along a vertical axis. These two machines basically differ in that the automatic machines can carry out a series of cycle start and end operations (for example, positioning the free edge of the film near the stack, cutting the film upon completion of wrapping and sealing the edge on the pack thus defined, etc.) using automatic devices and without the direct action of operators on the machine; in semi-automatic machines, on the other hand, operators are required in order to carry out these operations.

An automatic machine for wrapping a load is known from document EP-A-0 630 813. The machine comprises a device for supplying a pre-drawn film, a support for the load and a device for handling a free end of the film between two wrapping cycles. The handling device comprises a plate for holding the film against the load and a pair of jaws, located near one of the long edges of this plate, mobile with respect to one another along this edge to crumple and grip between them the portion of film contained between the plate and the film supply device.

Another automatic machine is known from document U.S. Pat. No. 5,138,818, comprising a turntable for supporting a load to be wrapped, a roll supplying a wrapping material, a wrapping material retaining mechanism mobile from a first position to a second position to retain the wrapping material near the turntable.

A method for cutting film used to wrap a group of products is known from document WO/9906279. The method comprises the step of reducing the width of the section of the film extending between the reel and the pack by means of relative means to define a band of film coplanar with the rotating platform. The method comprises the following steps of gripping the band-shaped section by a gripper and cutting unit attached to the outer edge of the rotating platform on which the pack is placed.

Obviously, these differences mean that the automatic machines are very expensive, used only for high productivity and are top of the range, whilst the semi-automatic machines are economically better suited to companies with medium-small production levels.

DISCLOSURE OF THE INVENTION

In order to bring the two types of machines closer together, the Applicant has designed a film DIVIDING apparatus for machines of the semi-automatic type, with which it is possible to automate the film dividing operation without significantly affecting the cost of the machine and leaving the structure and functions of the current semi-automatic machine unchanged.

The technical features of the present invention, in accordance with the above mentioned aims, are described in the claims herein, and the advantages of the invention are more clearly described in the detailed description below with reference to the accompanying drawings, which illustrate a preferred embodiment, and in which:

Figure 1:
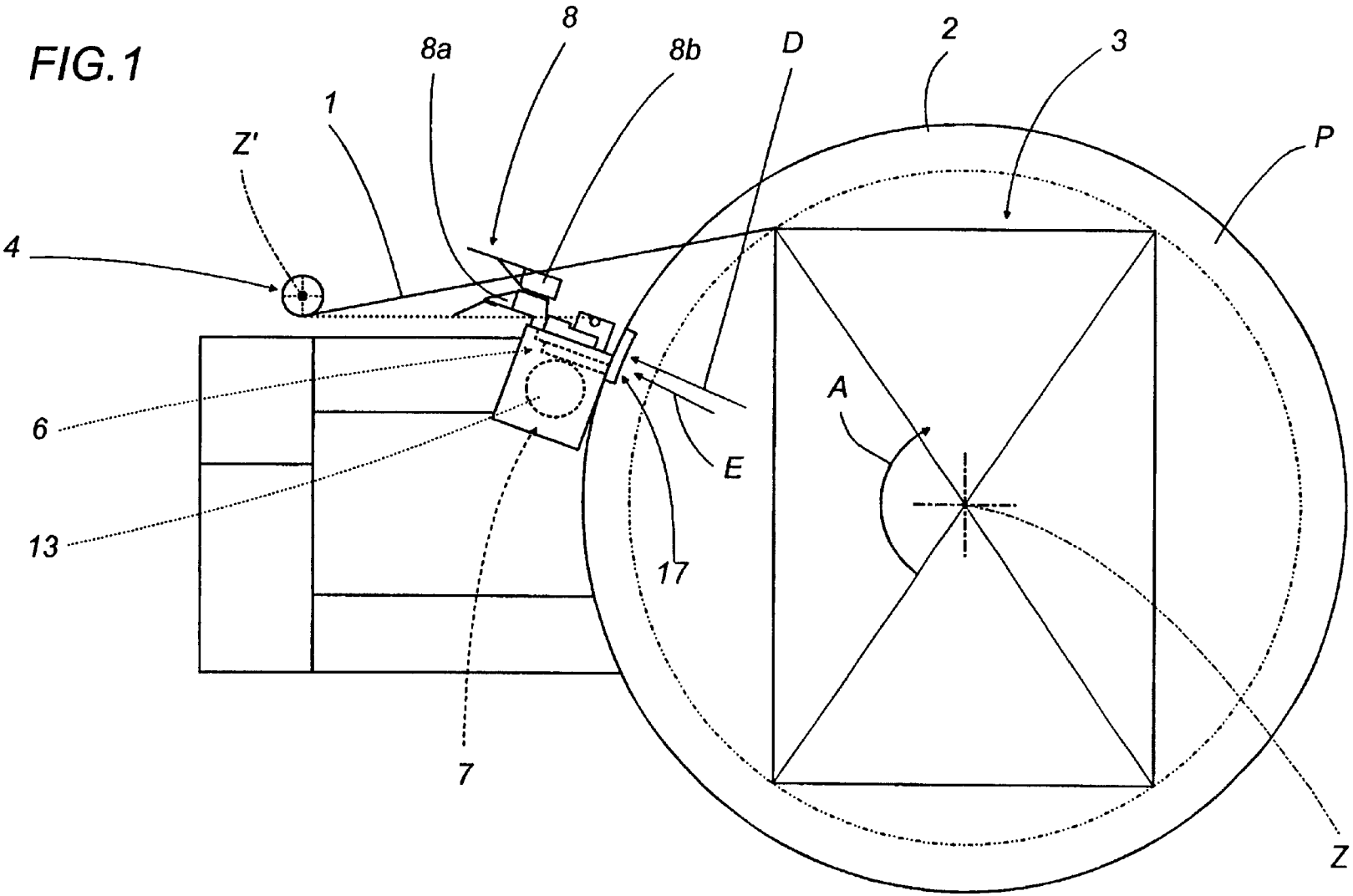
FIG. 1 is a schematic top plan view of a machine for wrapping groups of products, equipped with the holding and dividing apparatus made according to the present invention.

With reference to the accompanying drawings, in particular, FIG. 1, an apparatus 1 is used to hold and cut a length of plastic film 1 of width L (see FIG. 2) used to wrap palletised groups of products.

The machines that perform operations of this kind (particularly semiautomatic machines, although the apparatus disclosed is not restricted to machines of this type), basically comprise a platform 2 that rotates about its vertical axis Z and that supports on its surface P a group of products to be wrapped with the film 1, the platform 2 being rotated in the direction indicated by the arrow A in FIG. 1 to form a wrapped stack 3.

The film 1 is unwound from a reel 4, that rotates about its vertical axis Z', and that is supported by a frame (not illustrated since it is of known type) positioned near the platform 2. The frame moves up and down, carrying the reel 4 with it in such a way as to completely wrap the stack 3 in height.

Figure 2:
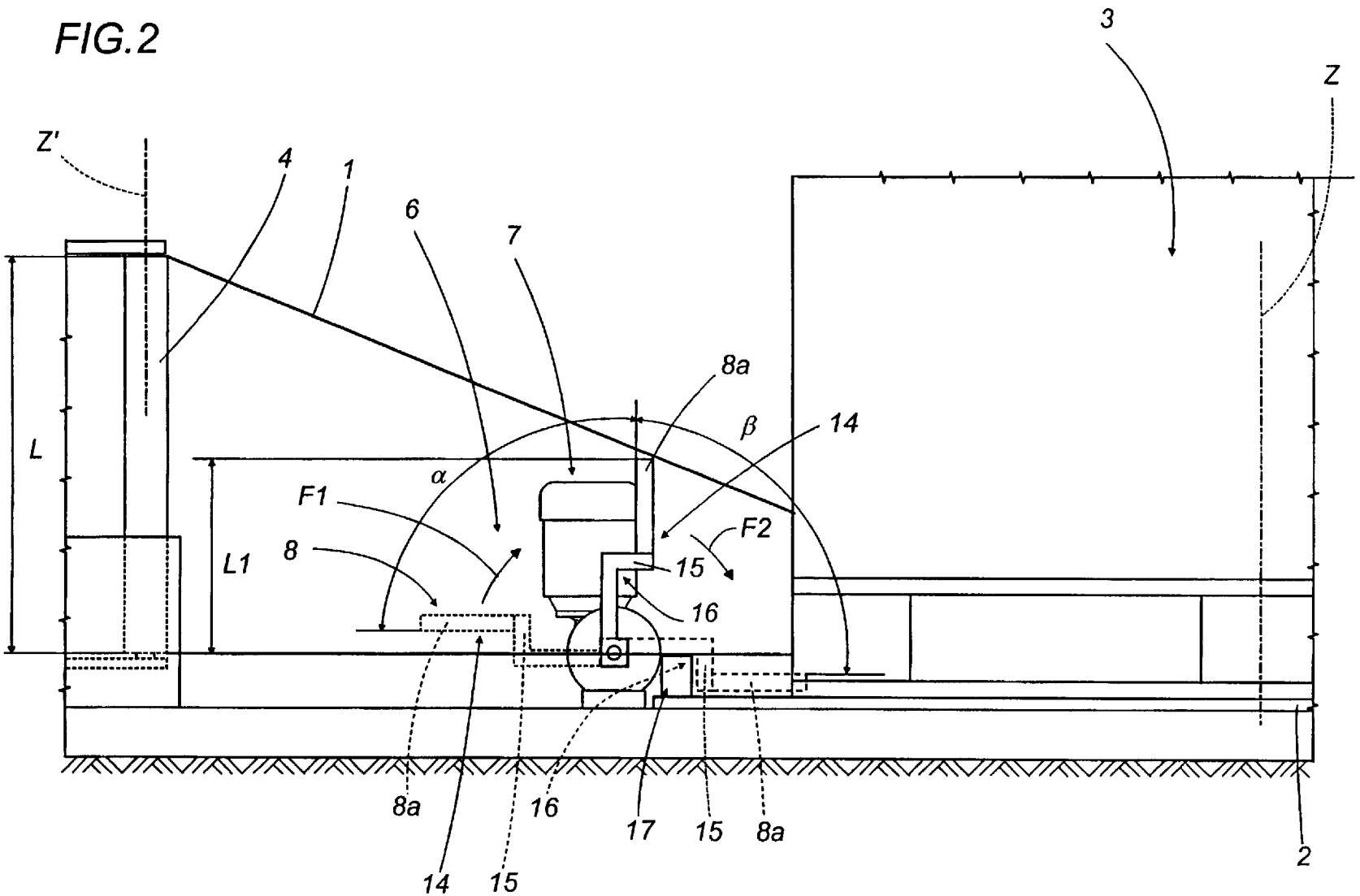
FIG. 2 is a schematic side view, with some parts cut away in order to better illustrate others, of the machine shown in FIG. 1.

When wrapping of the stack 3 has been completed and the reel 4 is in the lowermost position, as shown in FIG. 2, the dividing apparatus disclosed herein is activated.

This apparatus comprises a unit 6 which grips and tears the film 1, this unit being located outside the profile of the platform 2, close to the edge of the platform itself and being designed to intercept a portion of film of width L1 less than the total width L of the film 1 between the stack 3 and the reel 4 and to subsequently tear the portion of film 1, acting in conjunction with a rotational movement of the platform 2.

The unit 6 comprises a main gripper 8 consisting of two arms 8*a* and 8*b*, the first being equipped with a blade 8*l* and the second with a pressure plate 8*p* designed to hold and gather the torn portion of film 1.

Figure 3:
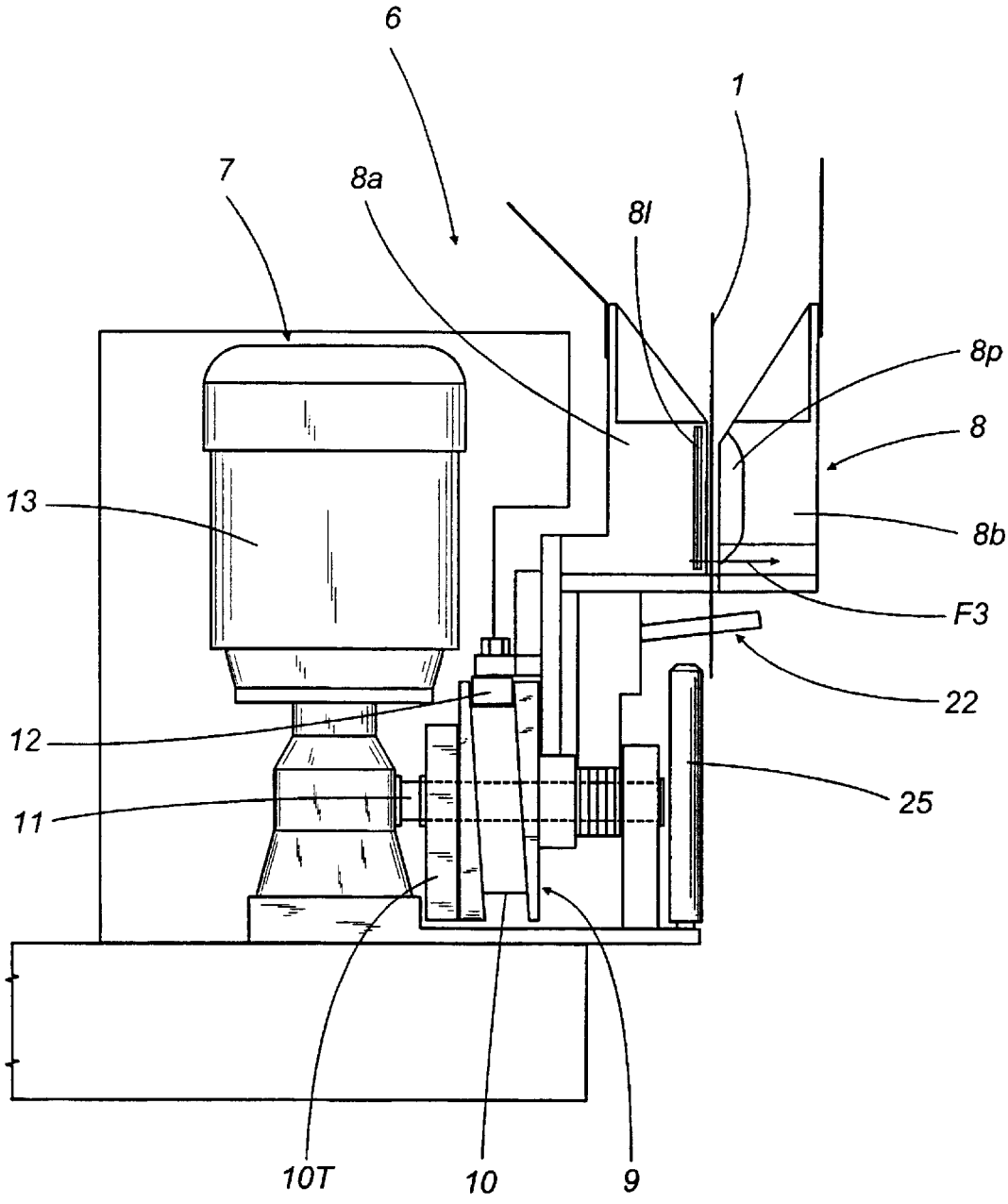
FIG. 3 is a view from D in FIG. 1 of the apparatus disclosed.

In order to intercept and tear the film 1, the main gripper 8 comprises drive means 7 which act on the gripper in such a way as to grip the portion of film 1 by performing a first rotation through a defined angle α to a position where the gripper is substantially vertical (see dashed line and arrow F1 in FIG. 2 and FIG. 3) with the film 1 placed between the two arms 8*a* and 8*b* of the gripper 8, and a second rotation through a further angle β to a position where the portion of film 1 is gathered and the main gripper 8 is substantially horizontal and over the platform 2 (see continuous line and arrow F2 in FIG. 2). In other words, the main gripper 8 initially lies outside the platform 2 (see FIG. 2) so as not to interfere with the wrapping of the stack 3 and then rotated through a straight angle while the platform 2 is also appropriately rotated in such a way as to intercept and cut the portion of film 1 (as described in more detail below).

The numeral 9 indicates cam means located and operating between the drive means 7 and the main gripper 8 in such a way as to hold the film 1 between the first and second arms 8*a* and 8*b* when the first and second rotations are performed in order to grip and gather the portion of film 1.

The cam means 9 (see FIG. 3 in particular) consist of a circular track 10 made on a drum 10T associated to a shaft 11 by which the main gripper 8 is driven. In this track 10 there runs a cam follower roller 12 attached to the first arm 8*a* of the main gripper 8 in such a way as to move the first arm from an idle position where the first arm 8*a* is away from the second arm 8*b* (as illustrated) to a working position (see arrow F3) where the first arm 8*a* is in contact with the second arm 8*b* in such a way as to grip and gather the portion of film 1.

The above mentioned drive means 7 of the main gripper 8 consist of a geared motor 13 connected, through the drive shaft 11, to the corresponding lower ends of the arms 8*a* and 8*b* forming the main gripper 8.

As clearly shown in FIGS. 1 and 2, the first and second arms 8*a* and 8*b* forming the main gripper 8 have a first, straight portion 14 and a second, angled portion 15 that form a passage 16 which, when the second tearing off rotation is performed, is located close to the outer edge of the platform 2. The gap 16 is used, as described in more detail below, by means 17 for gripping and completely tearing off the portion of film 1 torn by the main gripper 8.

The means 17 for gripping and completely tearing off the portion of film 1, located between the gripping and tearing unit 6 and the reel 4, are associated to the outer edge of the platform 2 and act as an element for holding the film 1 unwound from the reel 4 during the further rotation of the platform 2 in the wrapping direction A.

Figure 4:
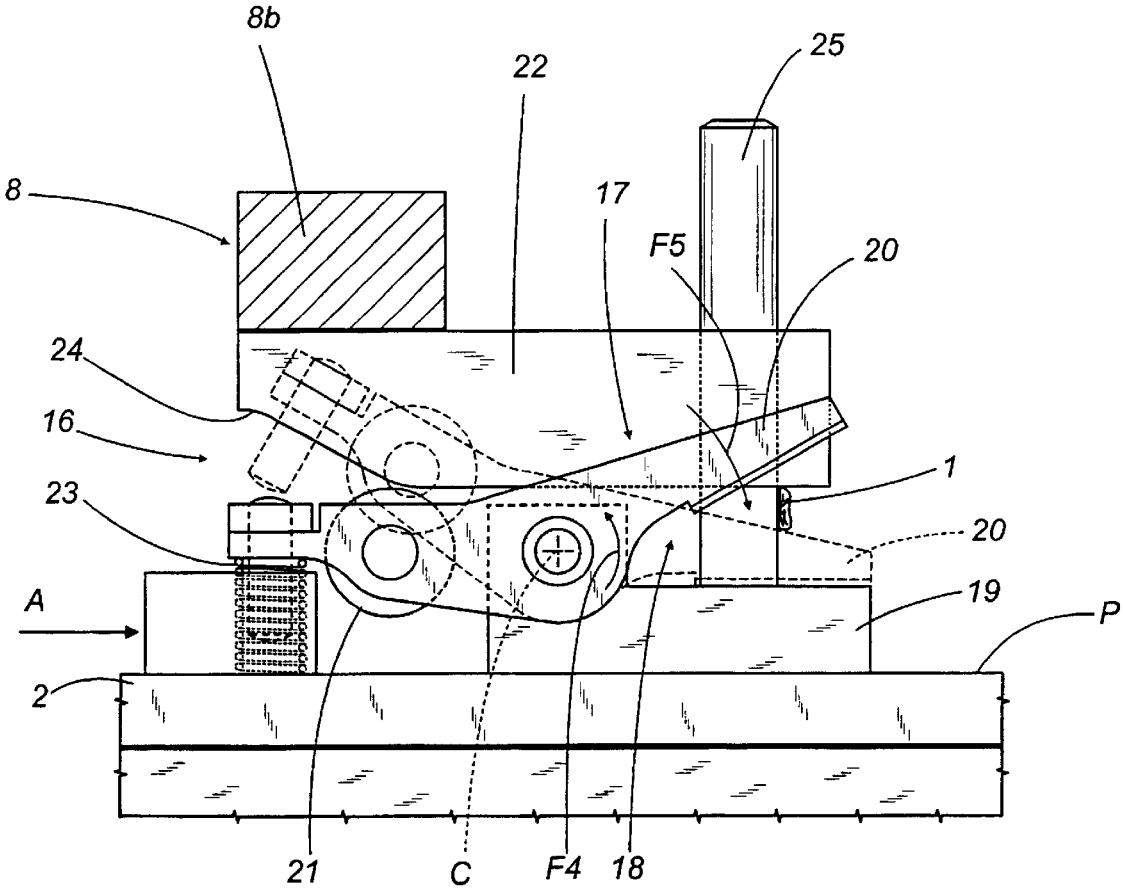
FIG. 4 is a detail view from E in FIG. 1 showing a part of the apparatus disclosed.

The gripping and tearing off means 17 (see FIG. 4) comprise a secondary gripper 18 consisting of a fixed arm 19 attached to the platform 2 and a mobile arm 20 pivoted, at C, to the support of the fixed arm which acts as a stop. The free end of the mobile arm 20 is equipped with a roller 21 which comes into contact with drive means 22 that act on the mobile arm in such a way as to move it away from the fixed arm 19 (see continuous line and arrow F4 in FIG. 4) by rotating it about the pivot C in such a way as to intercept, between the two arms 19 and 20, the gathered portion of film 1 being held by the gripping and tearing unit 6.

Spring means 23 act on the mobile arm 20 so that when the two arms 19 and 20 are moved away from the drive means 22, a rotation in the direction opposite to the previous direction (see arrow F5 in FIG. 4) is performed in such a way as to stop the portion of film 1 between the two arms 19 and 20 by lowering the mobile arm 20.

The above mentioned drive means 22 (see FIG. 4 again) consist of a shaped profile 24 associated to the first arm 8*a* of the main gripper 8 when it is in the tearing off position, that is to say, substantially horizontal over the platform 2.

The special "Z" shape of the arms 8*a* and 8*b* is such that the secondary gripper 18 can intercept the shaped profile 24 thanks to the passage 16 formed by the arms 8*a* and 8*b* of the main gripper 8 themselves (see also FIG. 2) during the rotation of the platform 2: in this way, the secondary gripper 18 is opened and the portion of film 1 previously gathered by the main gripper 8 can then be intercepted and gripped.

To keep the gathered portion of film 1 tensioned in the interception area of the secondary gripper 18, there is a vertical idle roller 25 which is mounted on the unit 6 close to the main gripper 8 in such a way as to tension the section of film 1 located near the interception area between the reel 4 and the main gripper 8 when the latter is in the horizontal tearing position over the platform 2.

In practice, the apparatus made in this way works in the following manner.

When a group of products has been positioned on the platform 2, the latter is activated and the reel 4 moves along its vertical axis Z' in order to wrap the group of products.

On completion of wrapping, the reel 4 is located at its lowermost point relative to the platform 2, in the position illustrated in FIGS. 1 and 2. The main gripper 8 is now moved by the geared motor 13 to the vertical position where the two arms 8*a* and 8*b* are moved close together in such a way as to stop the portion of film 1 whose width L1 is less than the total width L of the film 1. This starts tearing the film 1 and the tearing action is continued by rotating the platform 2 through a defined angle large enough to tear off the film 1 completely into two parts close to the gripping area of the gripper 8. Once the film 1 has been torn off, the gripper 8 turns to the second horizontal position over the platform 2, thus gathering the portion of film 1 and, if necessary, completing the tearing off action (if the previous rotation of the platform 2 was not sufficient to tear the film off completely).

Once this has been done and with the unit 6 and the platform 2 stopped in position, the wrapped stack 3 can be removed.

After removal, another stack of products can be placed and the platform 2 rotated again (without creating interference between the group of products and the main gripper 8) to enable the secondary gripper 18 to intercept and hold the section of film 1 stretched and gathered close to the main gripper 8.

It is now possible for the main gripper 8 to move back to its rest position, outside the profile of the platform 2, and for another wrapping cycle to be started with the front end of the film 1 held by the secondary gripper 18.

The wrapping cycle can be performed in this way to completion or, alternatively, the front end may be released when wrapping is at a certain point by stopping the platform 2 at a certain position, rotating the main gripper 8 over the platform 2 (without intercepting the film 1) and moving the platform only just enough to lift the secondary gripper 18 by contact with the profile 24, thus releasing the end of the film 1. The main gripper 8 is then rotated towards the outside of the platform 2 again and the wrapping cycle may continue.

The invention achieves the preset aims through an extremely simple and economical apparatus that is very easy to use and that is safe and reliable in gripping and dividing the wrapping film. Furthermore, the aims are achieved without altering the basic structure of the machine but adding an additional feature which automates the working cycle of the machines without significantly increasing their price.

The invention described can be subject to modifications and variations without thereby departing from the scope of the inventive concept. Moreover, all the details of the invention may be substituted by technically equivalent elements.

What is claimed is:

1. An apparatus for holding and dividing film (1) of width (L) used to wrap palletised groups of products in machines comprising a platform (2) that rotates about its vertical axis (Z) and that supports on its surface (P) a group of products to be wrapped with the film (1) to form a wrapped stack (3) by rotating the platform (2); the film (1) being unwound from a reel (4), that rotates about its vertical axis (Z'), and that is supported by a frame located near the platform (2) and designed to move the reel (4) up and down in such a way as to completely wrap the stack (3) in height; said apparatus comprising:

a unit (6) for gripping and tearing the film (1), located outside a profile of the platform (2) having a main gripper (8) with two arms (8*a*, 8*b*);

means (7) for driving the unit for gripping and tearing the film;

wherein the main gripper (8) is is rotatable in a plane parallel to the film (1), from a first position, in which the main gripper (8) lies outside the platform (2) and spaced from the film (1), to a second position, through a first rotation angle (α), in which the main gripper (8) is substantially vertical and holds a portion of film between the first (8*a*) and second arm (8*b*), to a third position, through a second rotation angle (β), in which the main gripper (8) is substantially horizontal over the platform (2) and holds the portion of film (1) between the first (8*a*) and second arm (8*b*);

wherein the unit for gripping and tearing the film further comprises:

cam means (9) located and operating between the drive means (7) and the main gripper (8) comprising a circular track (10) which is associated to a shaft (11) for rotating the main gripper (8) and within which there runs a cam follower roller (12) attached to the first arm (8*a*) of the main gripper (8) for moving the first arm (8*a*) from an idle position, where it is away from the second arm (8*b*), to a working position, where it is in contact with the second arm (8*b*).

2. The apparatus according to claim 1, wherein the means (7) for driving the main gripper (8) comprise a geared motor (13) connected, through a drive shaft (11), to the ends of the arms (8*a*, 8*b*) forming the main gripper (8).

3. The apparatus according to claim 2, wherein the first and second arms (8*a*, 8*b*) of the main gripper (8) comprise a first, straight portion (14) and a second, angled portion (15) that form a passage 16 which is located close to the outer edge of the platform (2) when the main gripper is moved to the third position.

4. The apparatus according to claim 2, wherein the gripping and tearing unit (6) comprises a vertical idle roller (25) mounted close to the main gripper (8) and designed to tension the portion of film (1) between the reel (4) and the main gripper (8) when the main gripper (8) is located in the horizontal tearing position over the platform (2).

5. The apparatus according to claim 1, wherein the first and second arms (8*a*, 8*b*) of the main gripper (8) have a first, straight portion (14) and a second, angled portion (15) that form a passage 16 which is located close to the outer edge of the platform (2) when the second rotation is performed in order to gather the film.

6. The apparatus according to claim 5, wherein the gripping and tearing unit (6) comprises a vertical idle roller (25) mounted close to the main gripper (8) and designed to tension the portion of film (1) between the reel (4) and the main gripper (8) when the main gripper (8) is located in the horizontal tearing position over the platform (2).

7. The apparatus according to claim 1, further comprising means (17) for gripping and tearing off the portion of film (1) between the gripping and tearing unit (6) and the reel (4), said means being associated to the outer edge of the platform (2) and being designed to grip the film when the platform (2) performs a further rotation.

8. The apparatus according to claim 7, wherein the gripping and tearing off means (17) comprise a secondary gripper (18) comprising a fixed arm (19) attached to the platform (2) and a mobile arm (20) pivoted, at (C), to the support of the fixed arm; the free end of the mobile arm (20) being equipped with a roller (21) which comes into contact with drive means (22) that act on the mobile arm (20) in such a way as to move it away from the fixed arm (19) by rotating it about the pivot (C) in such a way as to intercept, between the two arms (19, 20), the portion of film (1) being retained by the gripping and tearing unit (6); spring means (23) being provided to act on the mobile arm (20) so that when it is moved away from the drive means (22), a rotation in the direction opposite to the previous direction is performed in such a way as to stop the portion of film (1) between the two arms (19, 20).

9. The apparatus according to claim 8, wherein the drive means (22) comprise a shaped profile (24) associated to a first arm (8*a*) of a main gripper (8) when the main gripper (8) is substantially horizontal and located over the platform (2); and having an area or passage (16) allowing the secondary gripper (18) to move under the arms (8*a*, 8*b*) of the main gripper (8).

10. The apparatus according to claim 1, wherein the gripping and tearing unit (6) comprises a vertical idle roller (25) mounted close to the main gripper (8) and designed to tension the portion of film (1) between the reel (4) and the main gripper (8) when the latter is in the horizontal tearing position over the platform (2).

* * * * *